US008026826B2

(12) United States Patent
Chao

(10) Patent No.: US 8,026,826 B2
(45) Date of Patent: Sep. 27, 2011

(54) DOOR BELL WITH COMPACT PROFILE

(76) Inventor: Chuan Hao Chao, Tainan (TW)

( * ) Notice: Subject to any disclaimer, the term of this patent is extended or adjusted under 35 U.S.C. 154(b) by 401 days.

(21) Appl. No.: 12/403,323

(22) Filed: Mar. 12, 2009

(65) Prior Publication Data

US 2010/0231366 A1 Sep. 16, 2010

(51) Int. Cl.
*G08B 25/08* (2006.01)

(52) U.S. Cl. ..... 340/692; 340/396.1

(58) Field of Classification Search ..... 340/692, 340/396.1

See application file for complete search history.

(56) References Cited

U.S. PATENT DOCUMENTS 5,570,083 A * 10/1996 Johnson ..... 340/692

* cited by examiner

*Primary Examiner* — Travis Hunnings

(57) ABSTRACT

A door bell includes a case and a frame is located within the open space of the case. An electro-magnetic valve is connected to the frame and controls two hit pins and a circuit board is connected to the frame and electronically connected to the electro-magnetic valve. Two resilient members are mounted to the hit pins which hit a sound plate located beneath the hit pins to generate sound. The sound is amplified by two sound boxes. The circuit board transfers alternative current into direct current so that no hulky part projecting from the door bell.

5 Claims, 3 Drawing Sheets

DOOR BELL WITH COMPACT PROFILE

FIELD OF THE INVENTION

The present invention relates to a door bell, and more particularly, to a door bell which has a circuit to replace the adaptor so as to have a compact profile which is easily and conveniently installed.

BACKGROUND OF THE INVENTION

A conventional door bell is installed on the wall at the front gate so that the visitors can press the button of the door bell which generates sound to acknowledge the owner. One of the conventional door bells is shown in FIGS. 4 and 5, and generally includes a case with an open space in which an electro-magnetic valve 1 is located. Two hit pins 2 are controlled by the electro-magnetic valve 1 and two springs 3 are mounted to the hit pins 2. When the button (not shown) of the door bell is pressed, the electro-magnetic valve 1 is activated and the two hit pins 2 hit the sound plate 4 which generates sound. The sound generated by the sound plate 4 is amplified via two sound boxes 5 which are located on two sides of the electro-magnetic valve 1. The sound can be transferred to a long distance to ensure that the owner of the house can hear the sound from the door bell.

However, it is noted that the electro-magnetic valve 1 can only be activated by direct current (DC) of 16 Voltage and the power supply of the house is alternative current (AC) of 120 Voltage, so that an adaptor 6 is equipped to transfer the current to be usable for the electro-magnetic valve 6. The adaptor 6 is huge and projects out from the case as shown in FIG. 4, and the adaptor 6 makes the door bell to have an awkward profile. Because of the bulky adaptor 6, the difficulty for installation of the door bell is increased. Furthermore, the adaptor 6 makes the door bells occupy much larger space during transportation.

The present invention intends to provide a door bell which includes a circuit board to replace the electro-magnetic valve and the door bell of the present has a compact size without any part projecting from the door bell.

SUMMARY OF THE INVENTION

The present invention relates to a door bell comprises a case with an open space in which a frame is received and the frame closes the open space. An electro-magnetic valve is connected to the frame and controls at least one hit pin. A resilient member is mounted to the at least one hit pin which hits a sound plate located at a position corresponding to the at least one hit pin. Two sound boxes are cooperated with the sound plate so as to amplify the sound when the at least one hit pin hits the sound plate. A circuit board is connected to the frame and electronically connected to the electro-magnetic valve. The circuit board is located within the case so that the door bell is compact and easily to install.

The primary object of the present invention is to provide a door bell which does not have any part projecting therefrom and includes flat outsides.

Another object of the present invention is to provide a door bell which can be overlapped to reduce the space of transportation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
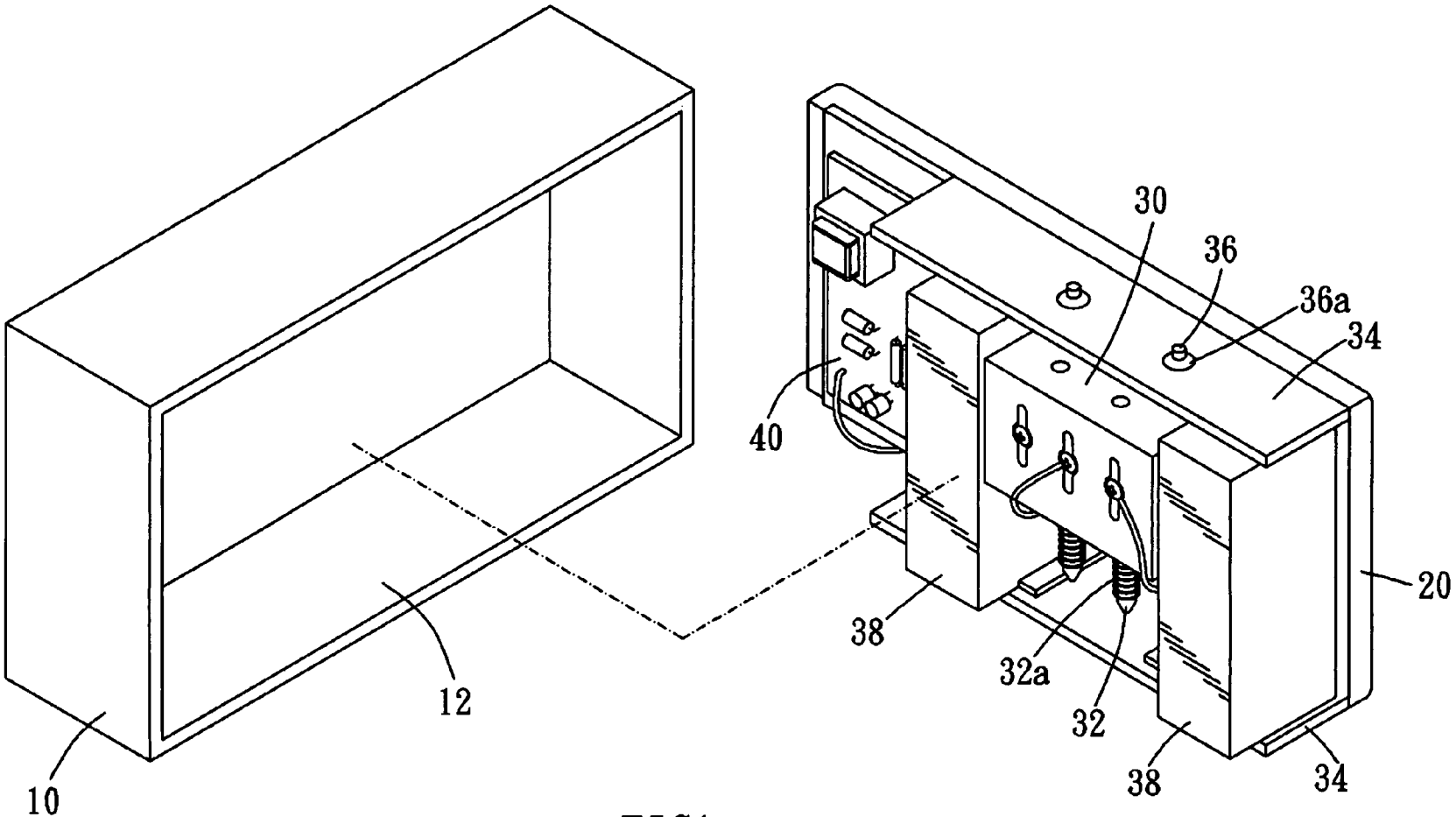
FIG. 1 is an exploded view to show the door bell of the present invention.
Figure 2:
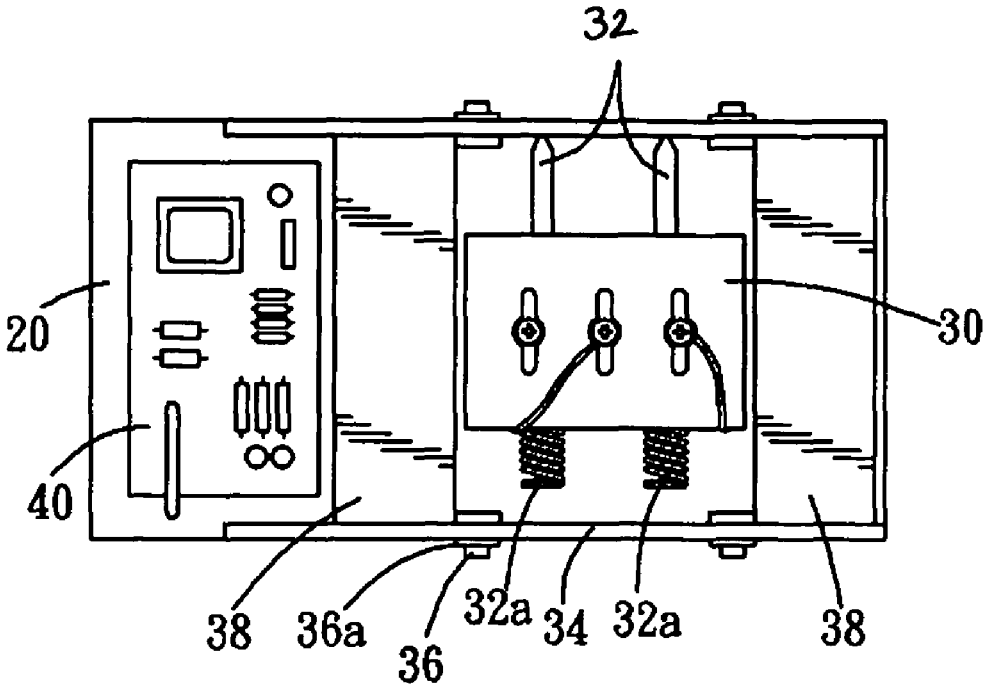
FIG. 2 shows that the hit pins hit the sound plate located above the hit pins.

Referring to FIGS. 1 and 2, the door bell of the present invention comprises a case 10 which is a rectangular case and has an open space 12. A frame 20 is located within the open space 12 of the case 10 to close the open space 20.

A circuit board 40 is connected to the frame 20 and electronically connected to an electro-magnetic valve 30. Two hit pins 32 are controlled by the electro-magnetic valve 30 and two resilient members 32*a* are mounted to the hit pins 32 so as to provide a force to return the hit pins 32. A U-shaped sound plate 34 is connected to the frame 20 by two connection rods 36 which extend through two sidewalls of the sound plate 34 and multiple rubber washers 36*a* are mounted to the connection rods 36. The two sidewalls of the sound plate 34 are located at positions corresponding to the hit pins 32. Two sound boxes 38 are located on two sides of the electro-magnetic valve 30 and cooperated with the sound plate 34.

When the visitor presses the button (not shown) of the door bell, the electro-magnetic valve 30 is activated and the hit pins 32 extend to hit the sound plate 34 to generate a sound. The sound is amplified by the sound boxes 38 which are hollow boxes so that the sound can be transferred to a long distance. When the visitor releases the button, the hit pins 32 return to their original positions by the resilient member 32*a*. In this embodiment, the resilient members 32*a* are compression springs.

Figure 3:
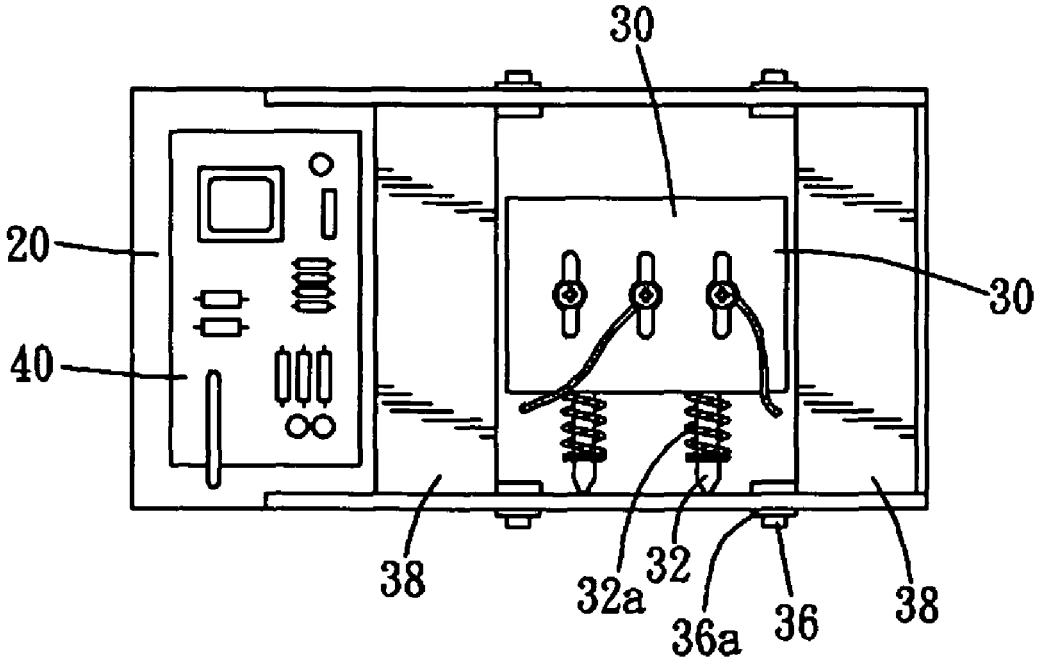
FIG. 3 shows that the hit pins hit the sound plate located beneath the hit pins.
Figure 4:
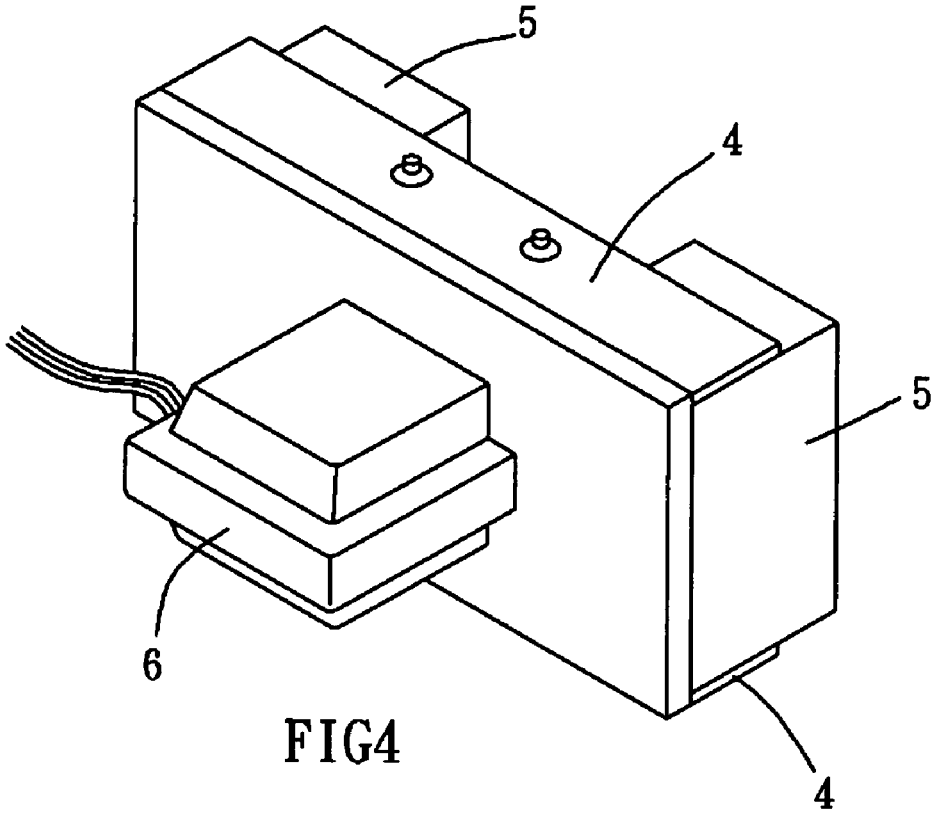
FIG. 4 is a perspective view to show the first side of the conventional door bell.
Figure 5:
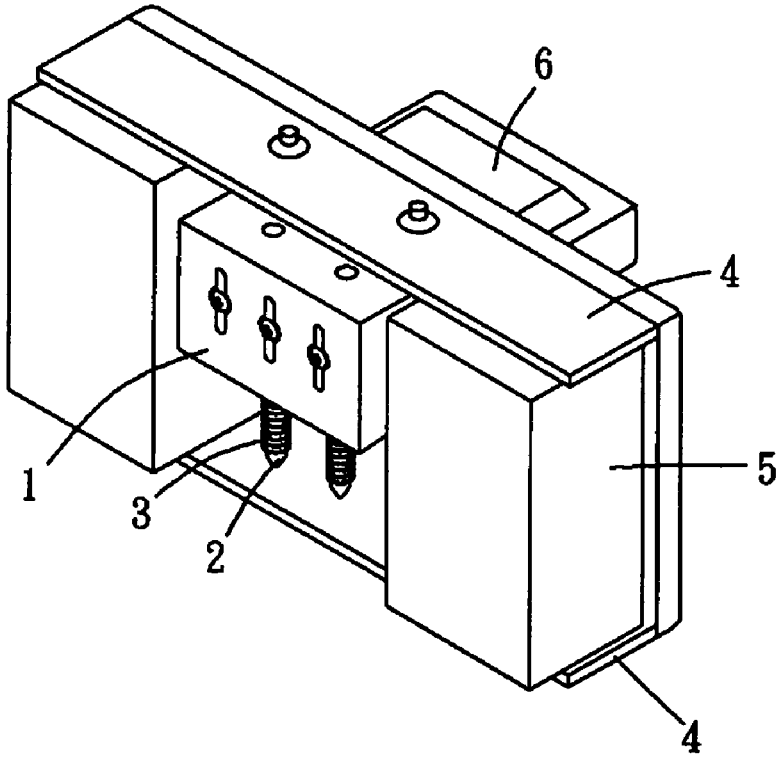
FIG. 5 is a perspective view to show the second side of the conventional door bell.

As shown in FIG. 3, the hit pins 32 can hit the sound plate 34 in another direction as shown. The door bell can also have a safety device such as a fuse which protects the door bell from burning if the visitor presses the button for a long period of time.

It is noted that the circuit board 40 transfers alternative current into direct current, and the circuit board 40 replaces the adaptor of the conventional door bell such that the door bell is compact and can be easily installed.

The compact door bell of the present invention has flat outsides which allow the door bells to be overlapped during transportation. The flat outsides also make the door bell to be easily installed on the wall.

While we have shown and described the embodiment in accordance with the present invention, it should be clear to those skilled in the art that further embodiments may be made without departing from the scope of the present invention.

What is claimed is:

1. A door bell comprising:

a case having an open space;

a frame located within the open space of the case to close the open space;

an electro-magnetic valve connected to the flame and having at least one hit pin, a resilient member mounted to the at least one hit pin and a sound plate located at a position corresponding to the at least one hit pin, two sound boxes cooperated with the sound plate, and a circuit board connected to the flame and electronically connected to the electro-magnetic valve.

2. The door bell as claimed in claim 1, wherein the at least one hit pin extends and hits the sound plate when the electro-magnetic valve is activated and the at least one hit pin returns to its original position by the resilient member.

3. The door bell as claimed in claim 1, wherein the resilient member is a compression spring.

4. The door bell as claimed in claim 1, wherein the circuit board transfers alternative current into direct current.

5. The door bell as claimed in claim 1, wherein the sound boxes are hollow boxes.

* * * * *